US010201848B2

(12) United States Patent
Takahashi et al.

(10) Patent No.: US 10,201,848 B2
(45) Date of Patent: Feb. 12, 2019

(54) CASTING DEVICE

(71) Applicant: HONDA MOTOR CO., LTD., Minato-ku, Tokyo (JP)

(72) Inventors: Hiroshi Takahashi, Tochigi-ken (JP); Kenichi Shuto, Tochigi-ken (JP); Toshihiro Takahashi, Tochigi-ken (JP); Masayuki Hattori, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/740,043

(22) PCT Filed: Jun. 27, 2016

(86) PCT No.: PCT/JP2016/068992

§ 371 (c)(1),
(2) Date: Dec. 27, 2017

(87) PCT Pub. No.: WO2017/002755

PCT Pub. Date: Jan. 5, 2017

(65) Prior Publication Data

US 2018/0193903 A1 Jul. 12, 2018

(30) Foreign Application Priority Data

Jul. 1, 2015 (JP) ..... 2015-132544

(51) Int. Cl.
*B22D 17/26* (2006.01)
*B22C 9/06* (2006.01)
(Continued)

(52) U.S. Cl.
CPC ..... *B22C 9/06* (2013.01); *B22D 17/26* (2013.01); *B22D 18/02* (2013.01); *B22D 18/04* (2013.01);
(Continued)

(58) Field of Classification Search
CPC ..... B22D 17/26–17/266; B29C 45/64; B29C 45/66; B29C 45/67
(Continued)

(56) References Cited

U.S. PATENT DOCUMENTS 3,768,951 A * 10/1973 Valyi ..... B29C 45/67 100/219
2002/0164395 A1* 11/2002 Yoshinaga ..... B29C 45/66 425/589
(Continued)

FOREIGN PATENT DOCUMENTS

JP 2008238181 A * 10/2008
JP 2013-086118 5/2013

OTHER PUBLICATIONS

International Search Report and Written Opinion for International Patent Application No. PCT/JP2016/068992 dated Aug. 9, 2016, 9 pages.

*Primary Examiner* — Kevin E Yoon
(74) *Attorney, Agent, or Firm* — Amin, Turocy & Watson LLP

(57) ABSTRACT

A casting device is provided with: a positioning member that is provided to a base and comes into contact with an upper mold and a slide member to define the positions of the upper mold and the slide member at the time of mold clamping; and a restraining force-applying mechanism for applying a restraining force to the slide member in a direction opposite a pressing force acting on the positioning member from the slide member at the time of mold clamping of the slide member.

8 Claims, 6 Drawing Sheets

(51) Int. Cl.

| | |
|---|---|
| ***B22D 18/04*** | (2006.01) |
| ***B22D 18/02*** | (2006.01) |
| *B22C 9/10* | (2006.01) |
| *B22C 9/22* | (2006.01) |
| *B22D 17/30* | (2006.01) |

(52) U.S. Cl.
CPC ..... *B22C 9/108* (2013.01); *B22C 9/22* (2013.01); *B22D 17/30* (2013.01)

(58) Field of Classification Search
USPC ..... 164/137, 339
See application file for complete search history.

(56) References Cited

U.S. PATENT DOCUMENTS

| | | | | |
|---|---|---|---|---|
| 2003/0017230 | A1* | 1/2003 | Yoshinaga | B29C 45/1761 425/589 |
| 2012/0276242 | A1* | 11/2012 | Huang | B22D 17/26 425/589 |
| 2013/0299117 | A1* | 11/2013 | Layton | B22C 9/062 164/137 |

* cited by examiner

CASTING DEVICE

TECHNICAL FIELD

The present invention relates to a casting device equipped with a lower mold fixed to a base, an upper mold arranged to face toward the lower mold and which is capable of moving up and down with respect to the lower mold, and a slide member arranged slidably with respect to the base.

BACKGROUND ART

In relation to this type of casting device, a configuration is disclosed in Japanese Laid-Open Patent Publication No. 2013-086118 in which four support posts (positioning members) are provided on a base, and by which an upper mold and slide molds (slide members) are brought into contact with each other to thereby specify positions of the upper mold and the slide molds at a time of mold clamping.

SUMMARY OF INVENTION

Incidentally, for example, in the case that a cylinder head of an automobile engine is cast with the casting device, the installation location of the support posts is limited by such features as the shape of the cylinder head (cast product) and the like, and situations may occur in which it is impossible to sufficiently secure the rigidity of the support posts. If this occurs, when the slide molds are placed in abutment against the support posts, the support posts may become inclined with respect to the base, and the slide molds may also become inclined with respect to the base.

If the slide molds become inclined with respect to the base, galling tends to occur and the cast product cannot be cast with high precision. In particular, in the case that casting is carried out using sand cores, the positions of the sand cores may become shifted or damage to the sand cores may occur. Further, in the case that the slide molds themselves collide with each other, the useful lifetime of the slide molds may be shortened, or it may be necessary to repair the molds at the parting line in certain cases.

It may also be considered to suppress inclination of the support posts when the slide molds come into contact with the support posts by adjusting the clamping force of the slide molds (the speed of movement of the slide molds at the time of mold clamping). However, in this case, it is necessary to adjust the clamping force of the slide molds every time that the shape of the cast product changes, which leads to a concern that the cycle time will become prolonged.

The present invention has been devised taking into consideration the aforementioned problems, and has the object of providing a casting device which is capable of casting cast products with high precision together with shortening the cycle time.

In order to achieve the aforementioned object, a casting device according to the present invention comprises a base, a lower mold fixed to the base, a slide member disposed so as to be capable of sliding with respect to the base, an upper mold arranged in facing relation and vertically movable with respect to the lower mold, a positioning member disposed on the base and configured to come into contact with the upper mold and the slide member to thereby specify positions of the upper mold and the slide member at a time of mold clamping, and a restraining force applying mechanism configured to apply a restraining force to the slide member in a direction opposite to a pressing force exerted on the positioning member from the slide member at the time of mold clamping of the slide member.

In accordance with the casting device which is configured in the above-described manner, since the pressing force exerted on the positioning member from the slide member can be suitably reduced by the restraining force of the restraining force applying mechanism, it is possible to prevent the positioning member from being inclined with respect to the base. Consequently, it is possible to suppress inclination of the slide member with respect to the base without adjusting the mold clamping force of the slide member, and therefore, it is possible for cast products to be cast with high precision together with shortening the cycle time.

In the above-described casting device, the slide member may include a first slide mold and a second slide mold arranged so as to face toward each other mutually, and the positioning member may include a first support post provided on the base and abutting against the upper mold and the first slide mold to thereby specify the positions of the upper mold and the first slide mold at the time of mold clamping, and a second support post provided on the base and abutting against the upper mold and the second slide mold to thereby specify the positions of the upper mold and the second slide mold at the time of mold clamping, and the casting device may further comprise a tie rod connected to the first slide mold and extended along a direction in which the first slide mold slides. The restraining force applying mechanism may be disposed on the tie rod and may apply a restraining force to the first slide mold which is opposite to a pressing force exerted on the first support post from the first slide mold at the time of mold clamping of the first slide mold.

In accordance with such a configuration, it is possible to suppress inclination of the first support post and the first slide mold with respect to the base.

In the above-described casting device, the restraining force applying mechanism may include a spring member configured to apply a spring force as the restraining force to the first slide mold before the first slide mold comes into contact with the first support post.

In accordance with such a configuration, the restraining force can be applied efficiently to the first slide mold by the spring force of the spring member. Consequently, with a simple configuration, it is possible to reliably suppress inclination of the first support post and the first slide mold.

In the above-described casting device, the tie rod may be disposed so as to penetrate through the second support post, and the spring member may be supported on the tie rod in a state of being positioned between the first slide mold and the second support post.

In accordance with such a configuration, the spring member, which is located between the first slide mold and the second support post at the time of mold clamping of the first slide mold, is pressed by the first slide mold and is elastically deformed. Therefore, the spring force of the spring member can be applied as a restraining force to the first slide mold. Further, since the spring force of the spring member can be applied to the second support post at the time of mold clamping of the first slide mold, it is possible to suppress inclination of the second support post with respect to the base due to the pressing force exerted on the second support post from the second slide mold at the time of mold clamping of the second slide mold.

In the above-described casting device, the restraining force applying mechanism may include a tubular spacer disposed on an outer circumferential side of the tie rod, and configured to press the spring member at the time of mold clamping of the first slide mold.

In accordance with such a configuration, even in the case that the total length of the spring member is comparatively short, the spring member can be elastically deformed reliably via the spacer at the time of mold clamping of the first slide mold.

In the above-described casting device, the restraining force applying mechanism may include a flange member disposed on the tie rod and positioned between the spring member and the first slide mold, and configured to press the spring member at the time of mold clamping of the first slide mold.

In accordance with such a configuration, even in the case that the total length of the spring member is comparatively short, the spring member can be elastically deformed reliably via the flange member at the time of mold clamping of the first slide mold.

In the above-described casting device, the restraining force applying mechanism may further comprise a movable shaft positioned on an opposite side of the first slide mold from that of the second slide mold, and provided on the tie rod in a state of being extended along an axial direction of the tie rod, a flange member provided on the movable shaft, and a fixed member disposed between the first slide mold and the flange member in a state of being immovable in the axial direction of the tie rod. The spring member may be interposed between the fixed member and the flange member in a state of being supported on the movable shaft.

In accordance with such a configuration, the spring member, which is located between the flange member and the fixed member at the time of mold clamping of the first slide mold, is pressed by the flange member and is elastically deformed. Therefore, the spring force of the spring member can be applied as a restraining force to the first slide mold. Consequently, it is possible to suppress inclination of the first support post and the first slide mold with respect to the base.

In the above-described casting device, the restraining force applying mechanism may further comprise a pressing member positioned on an opposite side of the second slide mold from that of the first slide mold, and provided on the tie rod, a support member disposed on an opposite side of the pressing member from that of the first slide mold in a state of being immovable in the axial direction of the tie rod, and a fixed shaft disposed on the support member, and extended along the axial direction of the tie rod so as to penetrate through the pressing member. The spring member may be interposed between the pressing member and the support member in a state of being supported on the fixed shaft.

In accordance with such a configuration, the spring member, which is located between the pressing member and the support member at the time of mold clamping of the first slide mold, is pressed by the pressing member and is elastically deformed. Therefore, the spring force of the spring member can be applied as a restraining force to the first slide mold. Consequently, it is possible to suppress inclination of the first support post and the first slide mold with respect to the base.

According to the present invention, since the pressing force exerted on the positioning member from the slide member can be suitably reduced by the restraining force of the restraining force applying mechanism, it is possible for cast products to be cast with high precision together with shortening the cycle time.

DESCRIPTION OF EMBODIMENTS

Preferred embodiments of a casting device according to the present invention will be presented and described in detail below with reference to the accompanying drawings.

A casting device 10 according to the present embodiment is a device used for casting, for example, a cylinder head of an in-line four-cylinder engine for an automobile by a low pressure casting method. However, the casting device 10 may be used as a device for casting a cast product having a shape other than the aforementioned cylinder head.

Figure 1:
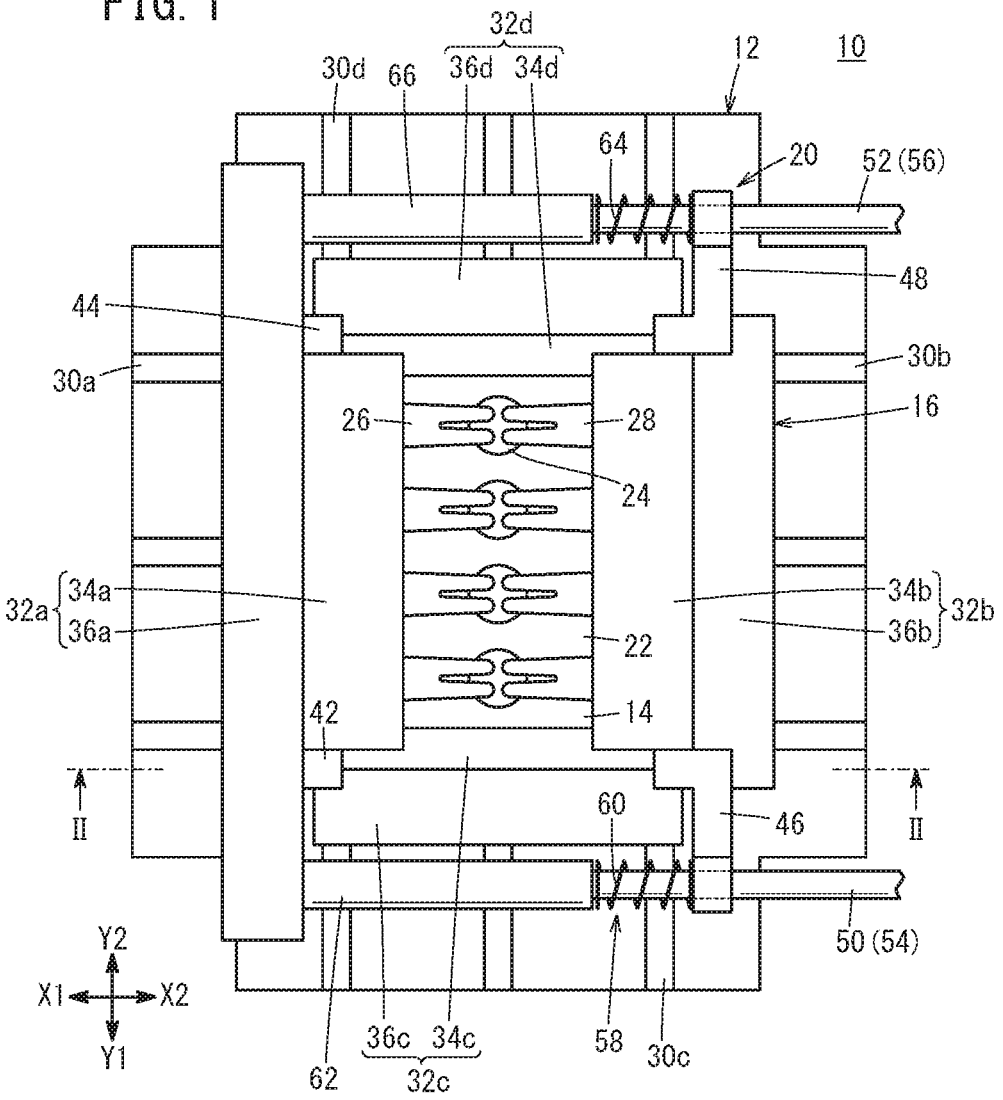
FIG. 1 is a schematic plan view of a casting device according to an embodiment of the present invention in which depiction of an upper mold is omitted.
Figure 2:
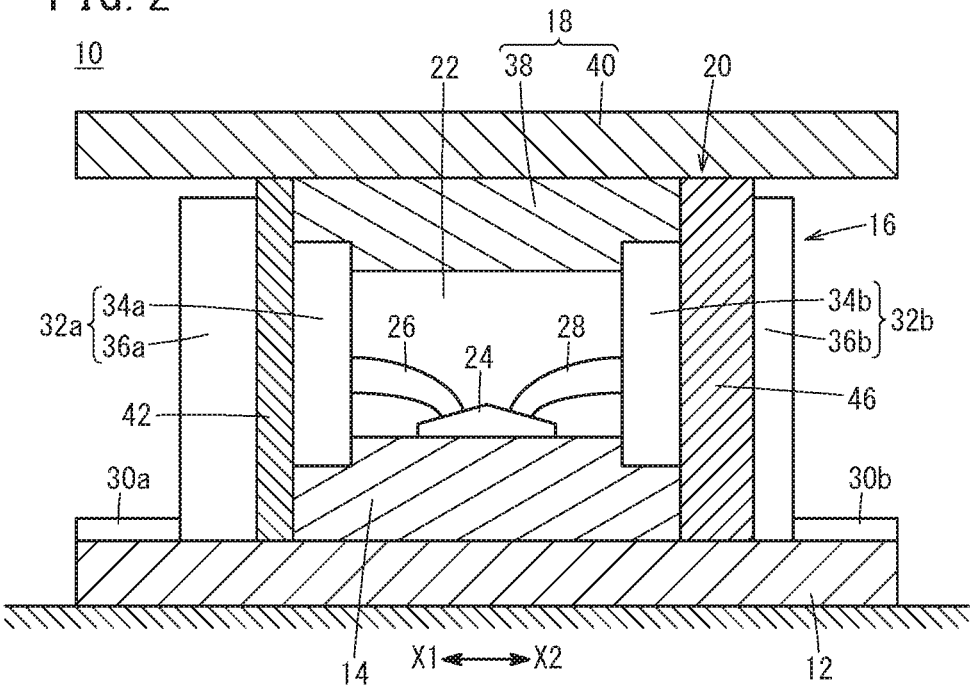
FIG. 2 is a cross-sectional view taken along line II-II of FIG. 1 in which depiction of a third slide mold is omitted.

As shown in FIGS. 1 and 2, the casting device 10 is equipped with a base 12, a lower mold 14 fixed to the base 12, a slide member 16 slidably disposed with respect to the base 12, an upper mold 18 arranged in facing relation to the lower mold 14 and vertically movable with respect to the lower mold 14, and a positioning member 20 provided on the base 12. A cavity 22 having a shape corresponding to the shape of the cylinder head is formed in the casting device 10 in a mold clamped state of the slide member 16 and the upper mold 18.

The lower mold 14, which has a rectangular shape viewed in plan and is used for molding a lower surface of the cylinder head, is disposed on the base 12. Four combustion chamber molding sections 24 that serve to mold the combustion chambers of the cylinder head are provided on the lower mold 14 along the longitudinal direction of the lower mold 14. An intake side sand core 26 for molding an intake port, and an exhaust side sand core 28 for molding an exhaust port are connected to each of the combustion chamber molding sections 24. The intake side sand cores 26 and the exhaust side sand cores 28 face toward each other along a lateral direction of the lower mold 14.

A plurality of first to fourth guide rails 30*a* to 30*d* are disposed on the base 12. The first guide rails 30*a* are positioned on a side (in the X1 direction) where the intake side sand cores 26 are located with respect to the combustion chamber molding sections 24, and the second guide rails 30*b* are positioned on a side (in the X2 direction) where the exhaust side sand cores 28 are located with respect to the combustion chamber molding sections 24. The first guide rails 30*a* and the second guide rails 30*b* extend along the lateral direction of the lower mold 14.

Further, the third guide rails 30*c* are positioned on one side (in the Y1 direction) in the longitudinal direction of the lower mold 14 with respect to the combustion chamber molding sections 24, and the fourth guide rails 30*d* are positioned on another side (in the Y2 direction) in the longitudinal direction of the lower mold 14 with respect to the combustion chamber molding sections 24. The third guide rails 30*c* and the fourth guide rails 30*d* extend along the longitudinal direction of the lower mold 14.

The slide member 16 has first to fourth slide molds 32*a* to 32*d*. The first slide mold 32*a* includes a first slide mold main body 34*a* adapted to mold a side surface in the X1 direction of the cylinder head, and a first sliding plate 36*a* to which the first slide mold main body 34*a* is fixed, and which slides along the first guide rails 30*a*. The second slide mold 32*b* includes a second slide mold main body 34*b* adapted to mold a side surface in the X2 direction of the cylinder head, and a second sliding plate 36*b* to which the second slide mold main body 34*b* is fixed, and which slides along the second guide rails 30*b*.

The third slide mold 32*c* includes a third slide mold main body 34*c* adapted to mold a side surface in the Y1 direction of the cylinder head, and a third sliding plate 36*c* to which the third slide mold main body 34*c* is fixed, and which slides along the third guide rails 30*c*. The fourth slide mold 32*d* includes a fourth slide mold main body 34*d* adapted to mold a side surface in the Y2 direction of the cylinder head, and a fourth sliding plate 36*d* to which the fourth slide mold main body 34*d* is fixed, and which slides along the fourth guide rails 30*d*.

The upper mold 18 includes an upper mold main body 38 adapted to mold an upper surface of the cylinder head, and a movable plate 40 to which the upper mold main body 38 is fixed, and which is moved up and down by a non-illustrated drive mechanism.

The positioning member 20 includes a pair of first support posts 42, 44 disposed on the X1 side of the base 12 in alignment with the longitudinal direction of the lower mold 14, and a pair of second support posts 46, 48 disposed on the X2 side of the base 12 in alignment with the longitudinal direction of the lower mold 14. The transverse cross section of the first support post 42 is formed in a rectangular shape, and the transverse cross section of the second support post 46 is formed in an L-shape.

A transverse cross-sectional area of the first support post 42 is smaller than the transverse cross-sectional area of the second support post 46. More specifically, the first support post 42 has a lower rigidity than that of the second support post 46. A height of the first support post 42 and a height of the second support post 46 are set to be equal to each other. The first support post 44 is configured in the same manner as the first support post 42, and the second support post 48 is configured in the same manner as the second support post 46, and therefore, detailed descriptions of the first support post 44 and the second support post 46 are omitted.

The pair of first support posts 42, 44 contact the movable plate 40 and the first sliding plate 36*a*, and regulate the positions of the upper mold 18 and the first slide mold 32*a* at the time of mold clamping. The pair of second support posts 46, 48 contact the movable plate 40 and the second sliding plate 36*b*, and regulate the positions of the upper mold 18 and the second slide mold 32*b* at the time of mold clamping. Further, the one first support post 42 and the one second support posts 46 contact the third sliding plate 36*c*, and regulate the position of the third slide mold 32*c* at the time of mold clamping. The other first support post 44 and the other second support post 48 contact the fourth sliding plate 36*d*, and regulate the position of the fourth slide mold 32*d* at the time of mold clamping.

Figure 3A:
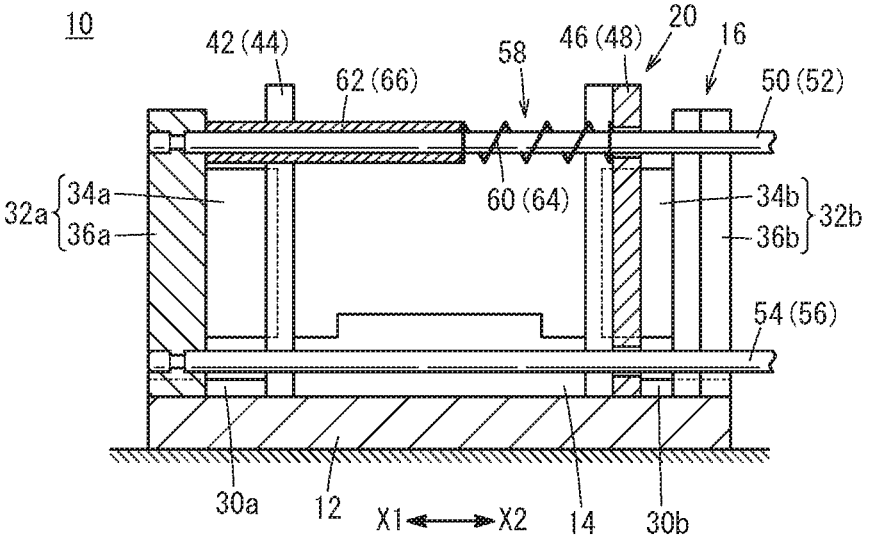
FIG. 3A is a schematic cross-sectional view showing a mold opened state of the casting device of FIG. 1.

As shown in FIGS. 1 and 3A, four tie rods 50, 52, 54, 56, which extend along the lateral direction of the lower mold 14 (the direction in which the first slide mold 32*a* slides) are connected to the first sliding plate 36*a*. The tie rods 50, 52, 54, 56 are positioned at the corners (four corners) of the first sliding plate 36*a*. The two tie rods 50, 54, which are positioned in the Y1 direction, extend so as to penetrate through the second support post 46, and the two tie rods 52, 56, which are positioned in the Y2 direction, extend so as to penetrate through the second support post 48.

The casting device 10 is further equipped with a restraining force applying mechanism 58 adapted to apply a restraining force to the first slide mold 32*a*, the restraining force being in an opposite direction to a pressing force exerted on the pair of first support posts 42, 44 from the first slide mold 32*a* at the time of mold clamping of the first slide mold 32*a*.

The restraining force applying mechanism 58 includes a first spring member 60 and a first spacer 62, which are provided on the upwardly positioned tie rod 50 in the Y1 direction, and a second spring member 64 and a second spacer 66, which are provided on the upwardly positioned tie rod 52 in the Y2 direction.

The first spring member 60 is supported on the tie rod 50 in a state of being positioned between the first sliding plate 36*a* and the second support post 46. For example, a compression coil spring is suitably used as the first spring member 60. However, any arbitrary type of spring such as a disc spring or the like can be used.

The first spacer 62 is a tubular member provided on an outer circumferential side of the tie rod 50, and is positioned between the first sliding plate 36*a* and the first spring member 60. More specifically, the first spring member 60 is interposed between the second support post 46 and the end surface of the first spacer 62. The first spacer 62 is constituted, for example, from a metal including iron or the like. The spring constant of the first spring member 60 as well as the length of the first spacer 62 are set appropriately depending on the magnitude of the spring force (restraining force) of the first spring member 60 to be exerted on the first sliding plate 36*a*.

The second spring member 64 and the second spacer 66 are configured in the same manner as the above-described first spring member 60 and the first spacer 62, and therefore, detailed description thereof is omitted.

In the restraining force applying mechanism 58, the positions of the first spring member 60 and the first spacer 62 may be reversed, and the first spring member 60 may be interposed between the first sliding plate 36*a* and an end surface of the first spacer 62. The same applies to the second spring member 64 and the second spacer 66.

Further, the first spacer 62 and the second spacer 66 may be dispensed with, and the first spring member 60 may be disposed over the entire length from the first sliding plate 36*a* up to the second support post 46, together with the second spring member 64 being disposed over the entire length from the first sliding plate 36*a* up to the second support post 48. Even with such a configuration, a predetermined restraining force can be applied with respect to the first sliding plate 36*a* by the first spring member 60 and the second spring member 64 at the time of mold clamping of the first slide mold 32*a*.

The casting device 10 according to the present embodiment is basically configured in the manner described above. Next, operations and effects of the casting device 10 will be described. In the following description, a mold opened state of the slide member 16 and the upper mold 18 is defined as an initial state. Moreover, as shown in FIG. 3A, in the opened state of the slide member 16, the first sliding plate 36*a* is not in contact with the first support posts 42, 44, and the second sliding plate 36*b* is also not in contact with the second support posts 46, 48.

In the case that casting of the cylinder head is to be carried out by the casting device 10, the intake side sand cores 26 and the exhaust side sand cores 28 are arranged respectively in each of the combustion chamber molding sections 24 provided on the lower mold 14, and a mold clamping process of the first to fourth slide molds 32*a* to 32*d* is performed.

More specifically, the tie rods 50, 52, 54, 56 are moved in the X2 direction by a non-illustrated drive mechanism, whereby the first slide mold 32*a* is made to slide in the X2 direction along the first guide rails 30*a*, and the second slide mold 32*b* is made to slide in the X1 direction along the second guide rails 30*b*. Further, by the non-illustrated drive mechanism, the third slide mold 32*c* is made to slide in the Y2 direction along the third guide rails 30*c*, and the fourth slide mold 32*d* is made to slide in the Y1 direction along the fourth guide rails 30*d*.

Figure 3B:
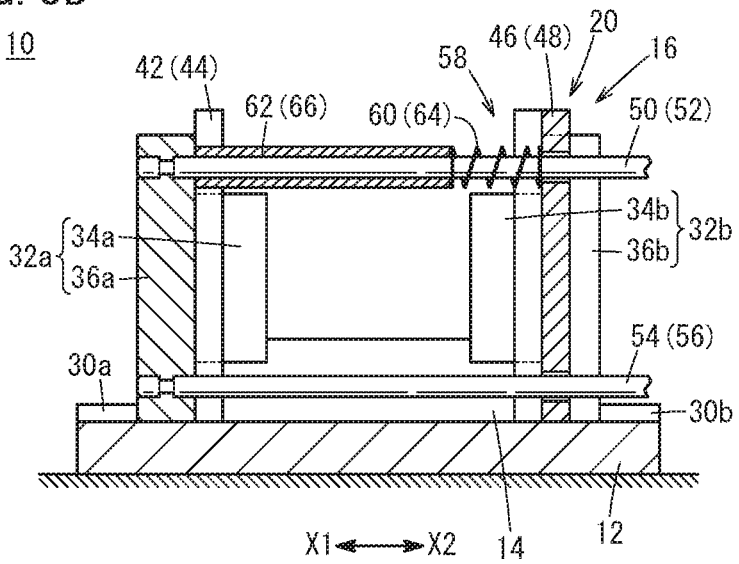
FIG. 3B is a schematic cross-sectional view showing a mold clamped state of the casting device.

As shown in FIG. 3B, when the first slide mold 32*a* is moved in the X2 direction, the first spacer 62 and the second spacer 66 move in the X2 direction accompanying movement of the first slide mold 32*a*, and therefore, the first spring member 60 and the second spring member 64 undergo elastic deformation (compressive deformation). When this occurs, a spring force (elastic force) in the X1 direction is exerted on the first sliding plate 36*a* via the first spacer 62 and the second spacer 66. The spring force increases as the first slide mold 32*a* continues to move in the X2 direction.

In addition, the first slide mold 32*a* is stopped by the first sliding plate 36*a* coming into abutment against the first support posts 42, 44, and the second slide mold 32*b* is stopped by the second sliding plate 36*b* coming into abutment against the second support posts 46, 48. In the same manner, the third slide mold 32*c* is stopped by the third sliding plate 36*c* coming into abutment against the first support post 42 and the second support post 46, and the fourth slide mold 32*d* is stopped by the fourth sliding plate 36*d* coming into abutment against the first support post 44 and the second support post 48.

At this time, since the spring force in the X1 direction is applied as a restraining force to the first sliding plate 36*a*, the pressing force in the X2 direction, which is exerted on the first support posts 42, 44 from the first sliding plate 36*a*, is suitably reduced. Consequently, even in the case that it is necessary for the rigidity of the first support posts 42, 44 to be kept comparatively low due to the layout relationship, in accordance with the pressing force received by the first support posts 42, 44 from the first sliding plate 36*a*, any inclination in the X2 direction with respect to the base 12 can be suppressed.

Further, the spring force in the X2 direction is exerted on the second support post 46 from the first spring member 60, and together therewith, the spring force in the X2 direction is exerted on the second support post 48 from the second spring member 64. Therefore, when the pressing force in the X1 direction is exerted from the second sliding plate 36*b* on the second support posts 46, 48, the second support posts 46, 48 are prevented from becoming inclined in the X1 direction with respect to the base 12. In this manner, since the first slide mold main body 34*a* and the second slide mold main body 34*b* are prevented from becoming inclined with respect to the lower mold 14, the intake side sand cores 26 and the exhaust side sand cores 28 are not shifted in position or damaged. Further, collision of the first slide mold 32*a* (or the second slide mold 32*b*) against the third slide mold 32*c* and the fourth slide mold 32*d* is also avoided.

Subsequently, the upper mold 18 is displaced downward by the non-illustrated drive mechanism. The upper mold 18 is stopped by the movable plate 40 coming into abutment against upper surfaces of the first support posts 42, 44 and upper surfaces of the second support posts 46, 48. Accordingly, the cavity 22 having a shape corresponding to the shape of the cylinder head is formed by the lower mold 14, the first to fourth slide mold main bodies 34*a* to 34*d*, and the upper mold main body 38.

Thereafter, a molten metal, which is stored in a non-illustrated crucible provided under the base 12, is supplied to the cavity 22 through a gate. Consequently, the molten metal is filled in the cavity 22, and the cylinder head is cast. Following mold opening of the upper mold 18 and the first to fourth slide molds 32*a* to 32*d*, the cast cylinder head is taken out. At this time, since inclination of the first slide mold 32*a* and the second slide mold 32*b* with respect to the base 12 is suppressed, the occurrence of galling can be prevented.

According to the present invention, the restraining force, which is in an opposite direction to the pressing force exerted on the first support posts 42, 44 from the first sliding plate 36*a* at the time of mold clamping of the first slide mold 32*a*, is applied to the first sliding plate 36*a* from the first spring member 60 and the second spring member 64. Therefore, it is possible to suitably reduce the pressing force that acts on the first support posts 42, 44. Owing to this feature, it is possible to suppress inclination of the first support posts 42, 44 with respect to the base 12. Thus, without adjusting the mold clamping force (speed of movement) of the first slide mold 32*a*, it is possible to suppress inclination of the first slide mold 32*a* with respect to the base 12. Accordingly, it is possible for cast products to be cast with high precision together with shortening the cycle time.

Further, according to the present embodiment, the first spring member 60 and the second spring member 64 are elastically deformed before the first sliding plate 36*a* comes into contact with the first support posts 42, 44, and therefore, it is possible for a predetermined restraining force to be applied efficiently to the first sliding plate 36*a*. Consequently, with a simple configuration, it is possible to reliably suppress inclination of the first slide mold 32*a*.

Furthermore, the first spacer 62 is disposed between the first sliding plate 36*a* and the first spring member 60, and together therewith, the second spacer 66 is disposed between the first sliding plate 36*a* and the second spring member 64. In accordance therewith, even in the case that the total lengths of the first spring member 60 and the second spring member 64 are comparatively short, the first spring member 60 and the second spring member 64 can be elastically deformed reliably at the time of mold clamping of the first slide mold 32*a*.

Further still, at the time of mold clamping of the first slide mold 32*a*, a spring force in the X2 direction is exerted on the second support post 46 from the first spring member 60, and together therewith, a spring force in the X2 direction is exerted on the second support post 48 from the second spring member 64. Therefore, at the time of mold clamping of the second slide mold 32*b*, it is possible to suppress inclination of the second support posts 46, 48 with respect to the base 12 due to the pressing force exerted on the second support posts 46, 48 in the X1 direction from the second sliding plate 36*b*.

The casting device 10 according to the present embodiment is not limited to the configuration described above. Instead of the restraining force applying mechanism 58, the casting device 10 may be equipped with restraining force applying mechanisms 58*a* to 58*c* according to the following first to third modifications described below.

(First Modification)

Figure 4A:
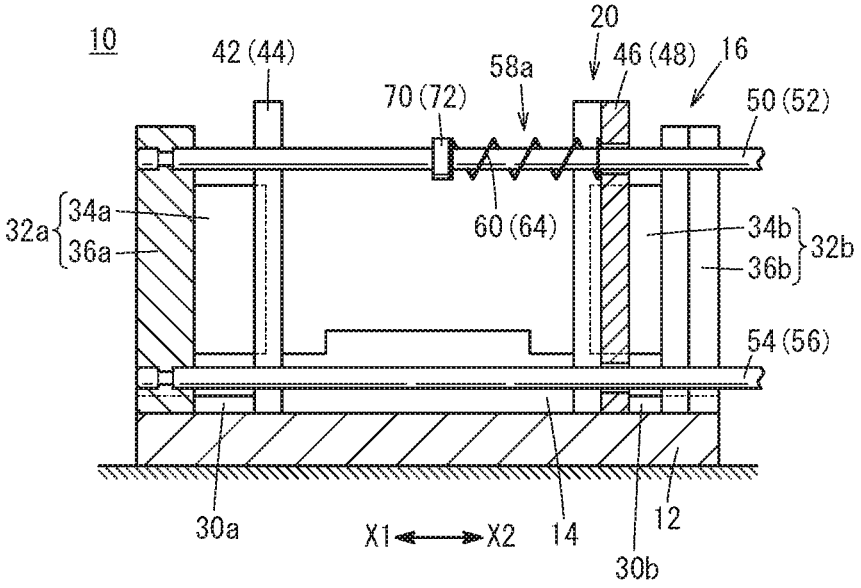
FIG. 4A is a schematic cross-sectional view showing a mold opened state of a casting device having a restraining force applying mechanism according to a first modification.

As shown in FIG. 4A, in a restraining force applying mechanism 58*a* according to a first modification, a first flange member 70 is provided in place of the first spacer 62, and a second flange member 72 is provided in place of the second spacer 66. The first flange member 70 is an annular member that projects outward in a radial direction from a position on the tie rod 50 separated a predetermined distance in the X2 direction from the first sliding plate 36*a*.

According to the present modification, the first flange member 70 is disposed integrally with respect to the tie rod 50. However, the first flange member 70 may be constructed separately from the tie rod 50, and may be fixed to the tie rod 50 using a fastening member or the like. The second flange member 72 is configured in the same manner as the first flange member 70, and therefore, detailed description thereof is omitted.

Figure 4B:
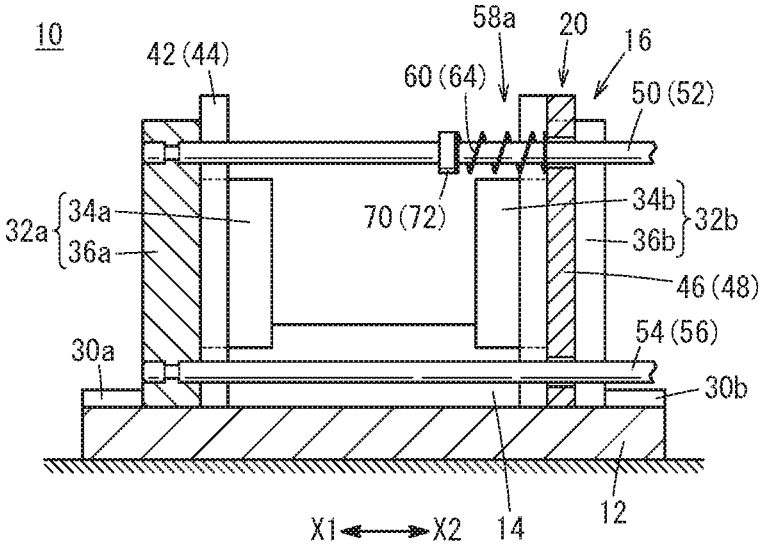
FIG. 4B is a schematic cross-sectional view showing a mold clamped state of the casting device.

In accordance with such a configuration, the same effects are exhibited as those of the case in which the above-described restraining force applying mechanism 58 is provided. More specifically, as shown in FIG. 4B, at the time of mold clamping of the first slide mold 32*a*, the first spring member 60 is pressed and elastically deformed by the first flange member 70, and the second spring member 64 is pressed and elastically deformed by the second flange member 72. Therefore, a spring force is applied as a restraining force in the X1 direction to the first slide mold 32*a* from the first spring member 60 and the second spring member 64. Consequently, it is possible to suppress inclination of the first support posts 42, 44 and the first slide mold 32*a* with respect to the base 12.

(Second Modification)

Figure 5A:
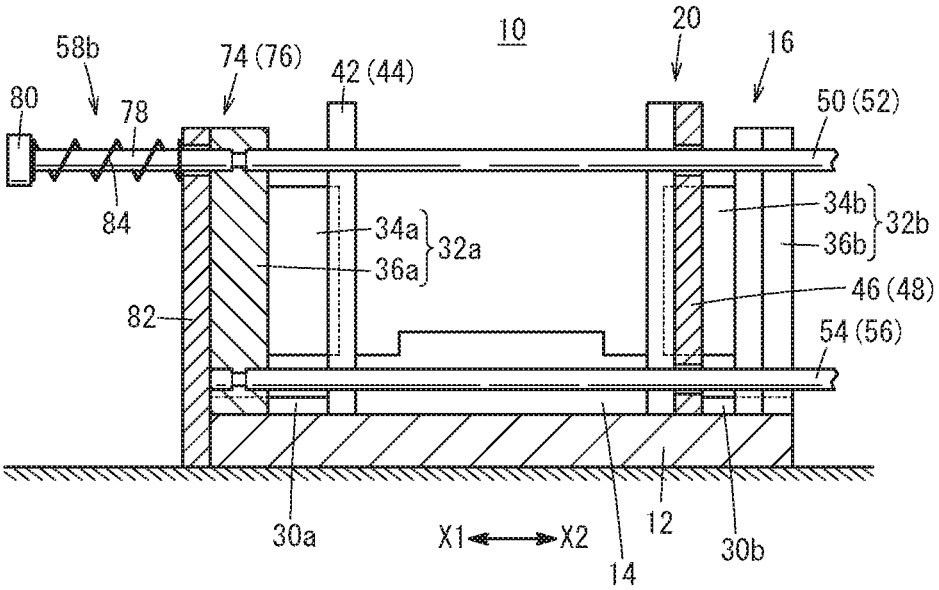
FIG. 5A is a schematic cross-sectional view showing a mold opened state of a casting device having a restraining force applying mechanism according to a second modification.

As shown in FIG. 5A, a restraining force applying mechanism 58*b* according to a second modification is located at a position (in the X1 direction) on an opposite side of the first slide mold 32*a* from that of the second slide mold 32*b*. The restraining force applying mechanism 58*b* includes a first mechanism 74 provided on the tie rod 50, and a second mechanism 76 provided on the tie rod 52. The first mechanism 74 has a movable shaft 78 that extends along the X1 direction from an end surface of the tie rod 50 in the X1 direction, and a flange member 80 disposed on an end in the X1 direction of the movable shaft 78.

Further, the first mechanism 74 includes a fixed member 82 disposed on the base 12 in a manner so that the movable shaft 78 penetrates through the fixed member 82 in a state that the fixed member 82 is immovable in the axial direction of the tie rod 50, and a spring member 84 interposed between the flange member 80 and the fixed member 82 in a state of being supported by the movable shaft 78. The fixed member 82 may be fixed to a floor surface without necessarily being disposed on the base 12. The spring member 84 is configured in the same manner as the aforementioned first spring member 60. The second mechanism 76 is configured in the same manner as the first mechanism 74, and therefore, detailed description thereof is omitted.

Figure 5B:
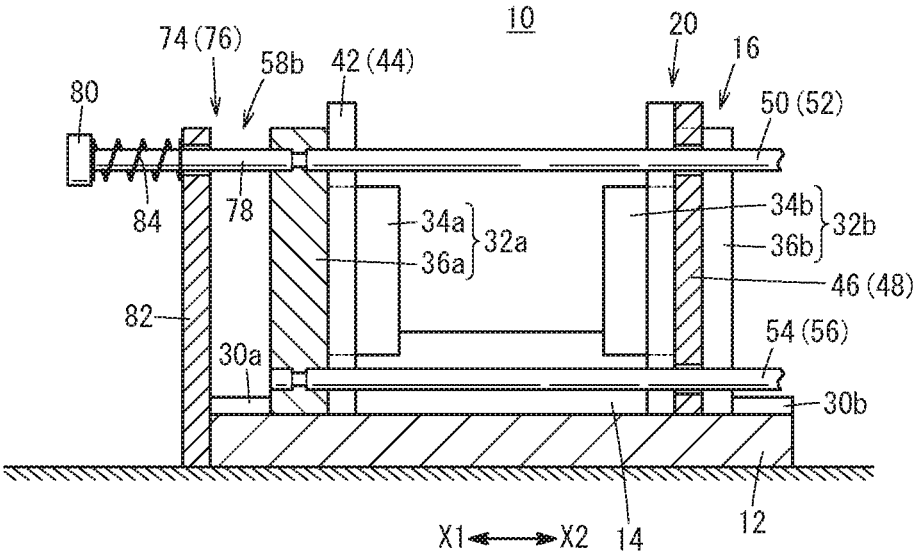
FIG. 5B is a schematic cross-sectional view showing a mold clamped state of the casting device.

In accordance with such a configuration, as shown in FIG. 5B, at the time of mold clamping of the first slide mold 32*a*, the spring members 84, which are positioned between the flange members 80 and the fixed member 82, are pressed and elastically deformed in the X2 direction by the flange members 80. Therefore, a spring force is applied as a restraining force in the X1 direction to the first slide mold 32*a* from the spring members 84. Consequently, it is possible to suppress inclination of the first support posts 42, 44 and the first slide mold 32*a* with respect to the base 12.

(Third Modification)

Figure 6A:
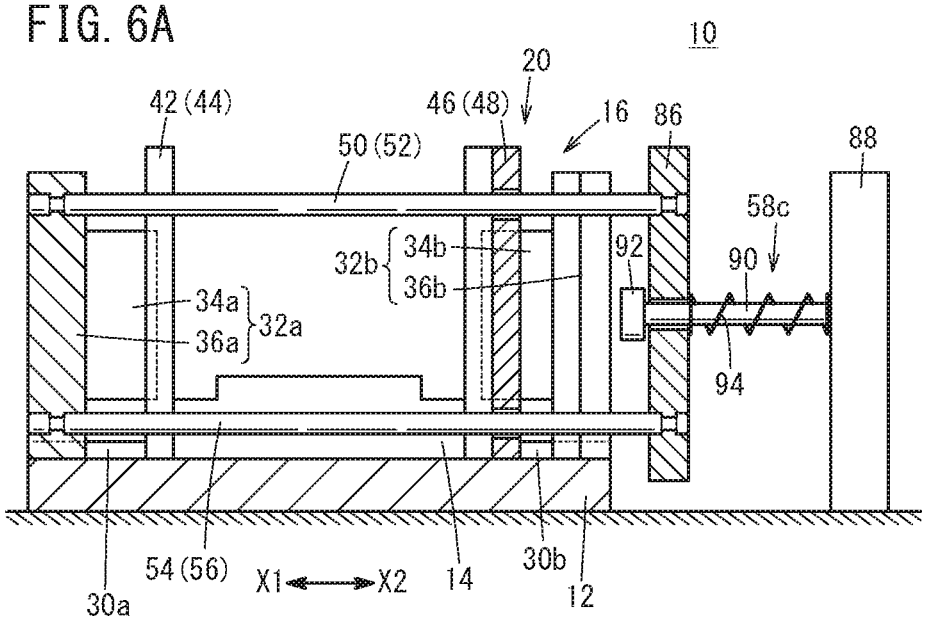
FIG. 6A is a schematic cross-sectional view showing a mold opened state of a casting device having a restraining force applying mechanism according to a third modification.

As shown in FIG. 6A, a restraining force applying mechanism 58*c* according to a third modification is located at a position (in the X2 direction) on an opposite side of the second slide mold 32*b* from that of the first slide mold 32*a*. The restraining force applying mechanism 58*c* includes a pressing member 86 fixed to ends in the X2 direction of the four tie rods 50, 52, 54, 56, and a support member 88 provided on a floor surface in a state of being immovable in the axial direction of the tie rod 50.

Further, the restraining force applying mechanism 58*c* includes a fixed shaft 90 which is fixed to the support member 88 and extends in an axial direction of the tie rod 50 so as to penetrate through the pressing member 86, and a stopper member 92 disposed on an end in the X1 direction of the fixed shaft 90. A spring member 94 is interposed between the pressing member 86 and the support member 88 in a state of being supported on the fixed shaft 90. The support member 88 may be fixed to the base 12 and not to the floor surface. The spring member 94 is configured in the same manner as the aforementioned first spring member 60.

Figure 6B:
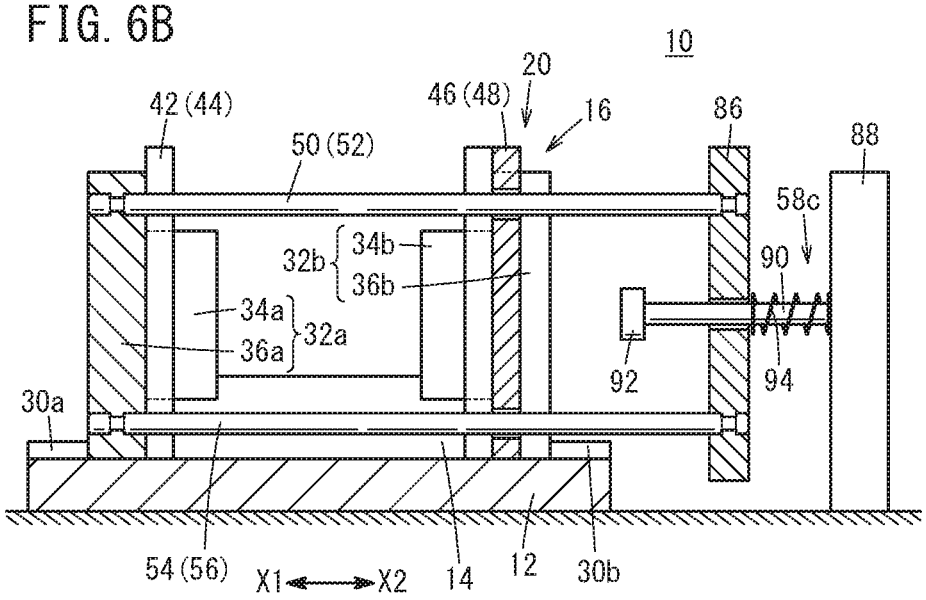
FIG. 6B is a schematic cross-sectional view showing a mold clamped state of the casting device.

In accordance with such a configuration, as shown in FIG. 6B, at the time of mold clamping of the first slide mold 32*a*, the spring member 94, which is positioned between the pressing member 86 and the support member 88, is pressed and elastically deformed in the X2 direction by the pressing member 86. Therefore, a spring force is applied as a restraining force in the X1 direction to the first slide mold 32*a* from the spring member 94. Consequently, it is possible to suppress inclination of the first support posts 42, 44 and the first slide mold 32*a* with respect to the base 12.

In the casting device 10 according to the present embodiment, a restraining force applying mechanism may further be provided in which, for example, a restraining force is applied to the third slide mold 32*c* in a direction opposite to the pressing force exerted on the first support post 42 and the second support post 46 from the third slide mold 32*c*. The restraining force applying mechanism may adopt the same configuration as any of the restraining force applying mechanisms 58 and 58*a* to 58*c* described above. Moreover, in this case, a plurality of tie rods that extend along the longitudinal direction of the lower mold 14 are further provided. In accordance with such a configuration, the pressing force exerted on the first support post 42 and the second support post 46 from the third slide mold 32*c* can be suitably reduced, and therefore, it is possible to prevent inclination of the first support post 42 and the second support post 46 with respect to the base 12.

The restraining force applying mechanism may be configured in a manner so that a restraining force is applied to the fourth slide mold 32*d* in a direction opposite to the pressing force exerted on the first support post 44 and the second support post 48 from the fourth slide mold 32*d*. In this case, the pressing force exerted on the first support post 44 and the second support post 48 from the fourth slide mold 32*d* can be suitably reduced, and therefore, it is possible to prevent inclination of the first support post 44 and the second support post 48 with respect to the base 12.

What is claimed is:

1. A casting device comprising:

a base;

a lower mold fixed to the base;

a slide member disposed so as to be capable of sliding with respect to the base;

an upper mold arranged in facing relation and vertically movable with respect to the lower mold;

a positioning member disposed on the base and configured to come into contact with the upper mold and the slide member to thereby specify positions of the upper mold and the slide member at a time of mold clamping; and a restraining force applying mechanism configured to apply a restraining force to the slide member in a direction opposite to a pressing force exerted on the positioning member from the slide member at the time of mold clamping of the slide member.

2. The casting device according to claim 1, wherein:

the slide member includes a first slide mold and a second slide mold arranged so as to face toward each other mutually;

the positioning member includes:

a first support post provided on the base and abutting against the upper mold and the first slide mold to thereby specify the positions of the upper mold and the first slide mold at the time of mold clamping; and a second support post provided on the base and abutting against the upper mold and the second slide mold to thereby specify the positions of the upper mold and the second slide mold at the time of mold clamping;

the casting device further comprises a tie rod connected to the first slide mold and extended along a direction in which the first slide mold slides; and wherein the restraining force applying mechanism is disposed on the tie rod and applies a restraining force to the first slide mold which is opposite to a pressing force exerted on the first support post from the first slide mold at the time of mold clamping of the first slide mold.

3. The casting device according to claim 2, wherein the restraining force applying mechanism includes a spring member configured to apply a spring force as the restraining force to the first slide mold before the first slide mold comes into contact with the first support post.

4. The casting device according to claim 3, wherein:

the tie rod is disposed so as to penetrate through the second support post; and the spring member is supported on the tie rod in a state of being positioned between the first slide mold and the second support post.

5. The casting device according to claim 4, wherein the restraining force applying mechanism includes a tubular spacer disposed on an outer circumferential side of the tie rod, and configured to press the spring member at the time of mold clamping of the first slide mold.

6. The casting device according to claim 4, wherein the restraining force applying mechanism includes a flange member disposed on the tie rod together with being positioned between the spring member and the first slide mold, and configured to press the spring member at the time of mold clamping of the first slide mold.

7. The casting device according to claim 3, wherein the restraining force applying mechanism further comprises:

a movable shaft positioned on an opposite side of the first slide mold from that of the second slide mold, and provided on the tie rod in a state of being extended along an axial direction of the tie rod;

a flange member provided on the movable shaft; and a fixed member disposed between the first slide mold and the flange member in a state of being immovable in the axial direction of the tie rod;

wherein the spring member is interposed between the fixed member and the flange member in a state of being supported on the movable shaft.

8. The casting device according to claim 3, wherein the restraining force applying mechanism further comprises:

a pressing member positioned on an opposite side of the second slide mold from that of the first slide mold and provided on the tie rod;

a support member disposed on an opposite side of the pressing member from that of the first slide mold in a state of being immovable in the axial direction of the tie rod; and a fixed shaft disposed on the support member, and extended along the axial direction of the tie rod so as to penetrate through the pressing member;

wherein the spring member is interposed between the pressing member and the support member in a state of being supported on the fixed shaft.

* * * * *